United States Patent [19]

Adamson et al.

[11] 4,096,704

[45] Jun. 27, 1978

[54] OFFSHORE PRODUCT LOADING TERMINAL

[75] Inventors: Stewart Marr Adamson; Alan Edgar John Bliault, both of Portchester, England

[73] Assignee: David Brown-Vosper (Offshore) Limited, Portchester, England

[21] Appl. No.: 742,123

[22] Filed: Nov. 15, 1976

[51] Int. Cl.[2] ..... E02B 17/00; B63B 27/24

[52] U.S. Cl. ..... 61/95; 9/8 P; 114/230; 141/387; 141/388

[58] Field of Search ..... 61/95, 101, 94, 48; 9/8 P; 141/387, 388; 114/230

[56] References Cited

U.S. PATENT DOCUMENTS

| | | | |
|---|---|---|---|
| 3,120,106 | 2/1964 | Foster | 61/48 X |
| 3,407,416 | 10/1968 | Brickhouse | 9/8 P |
| 3,455,270 | 7/1969 | Mascenik et al. | 9/8 P X |
| 3,838,720 | 10/1974 | Van Hulstijn et al. | 9/8 P X |
| 3,894,567 | 7/1975 | Mott et al. | 9/8 P X |
| 3,942,204 | 3/1976 | Gruy | 9/8 P |
| 3,980,037 | 9/1976 | Tuson | 9/8 P X |
| 4,010,500 | 3/1977 | Reid, Jr. | 9/8 P |

*Primary Examiner*—Jacob Shapiro
*Attorney, Agent, or Firm*—Michael J. Striker

[57] ABSTRACT

An offshore product loading terminal has a support which is secured an an anchor and which carries a pipe swivel. A product pipe from a product source is intended to be connected to the pipe swivel, the input and output of which are capable of relative rotation about a vertical axis. The turntable also permits relative rotation about the vertical axis and carries a buoy through a universal coupling. The buoy carries a mooring point for a ship and is divided into a plurality of compartments individually sealed.

11 Claims, 4 Drawing Figures

OFFSHORE PRODUCT LOADING TERMINAL

This invention relates to an offshore product loading terminal.

According to this invention there is provided an offshore product loading terminal comprising a support intended to rest directly or indirectly on the sea bed, a pipe swivel carried by the support and to which a product pipe from a product source is intended to be connected, the output and the input of the swivel being capable of relative rotation about a vertical axis.

Preferably the support is intended to be secured to an anchor secured by gravity or otherwise to the sea bed.

Preferably the support also carries a turntable permitting relative rotation about the said vertical axis and intended to carry a buoy intended to carry a mooring point for a ship.

In use the buoy is permitted rotation about the vertical axis by the turntable.

Preferably the buoy is carried by the turntable through a universal coupling which permits pivoting of the buoy about two orthogonal horizontal axes.

An embodiment of this invention will now be described, by way of example only, with reference to the accompanying drawings of which:

Figure 1:
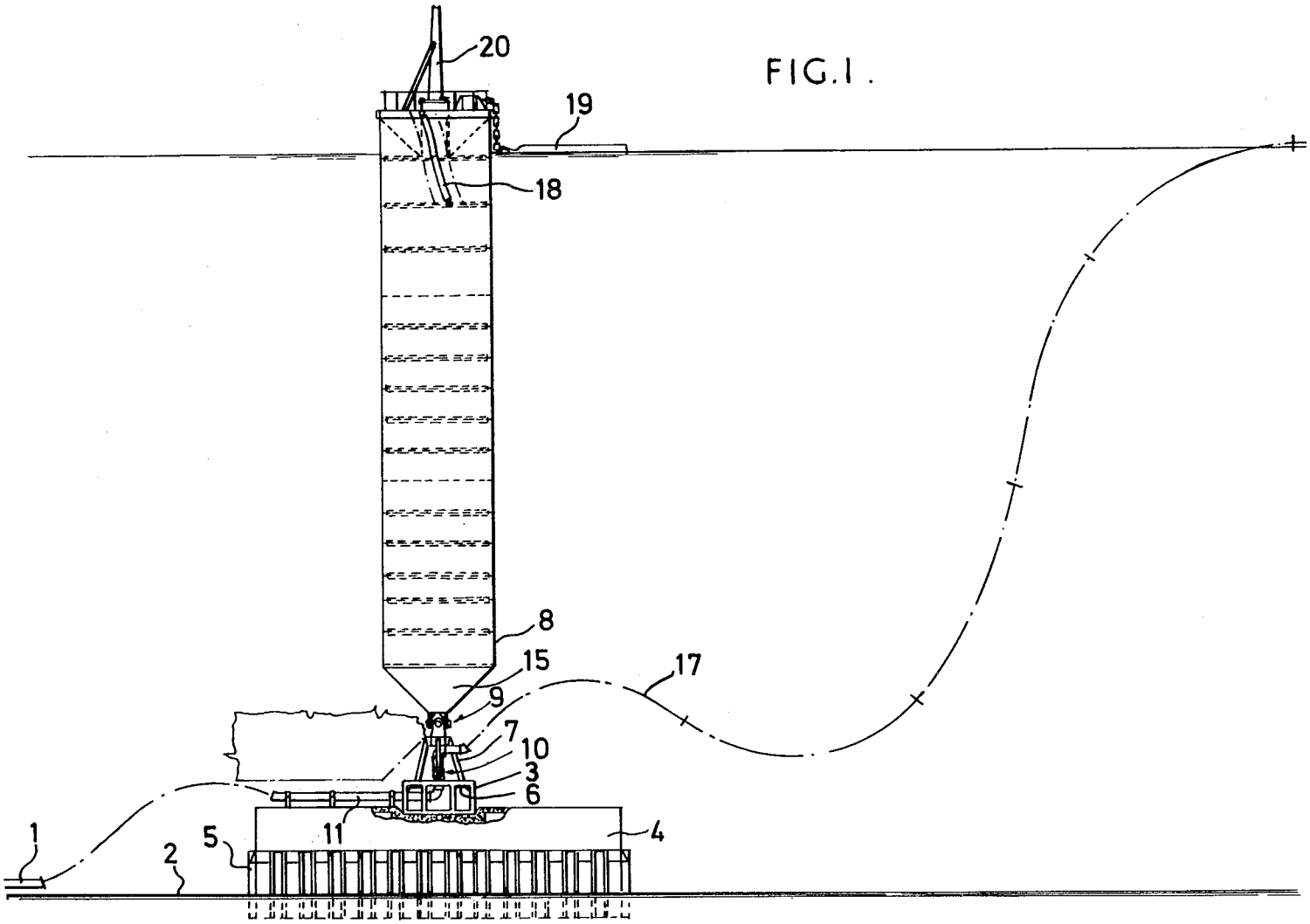
FIG. 1 is a schematic side view of a loading terminal in accordance with this invention.

Referring to the drawings two slurry flow lines 1 from a product source on the sea bed 2 lead to a steel mooring frame 3 resting on a gravity anchor 4. The gravity anchor 4 has a fitted structural steel skirt 5 which transmits the applied horizontal loadings from the anchor 4 to the sea bed 2.

The mooring frame 3 carries a turntable 6 which carries a conical structure 7 which supports a vertically extending steel buoy 8 through a universal coupling 9 which permits rotation about two orthogonal horizontal axes.

Figure 2:
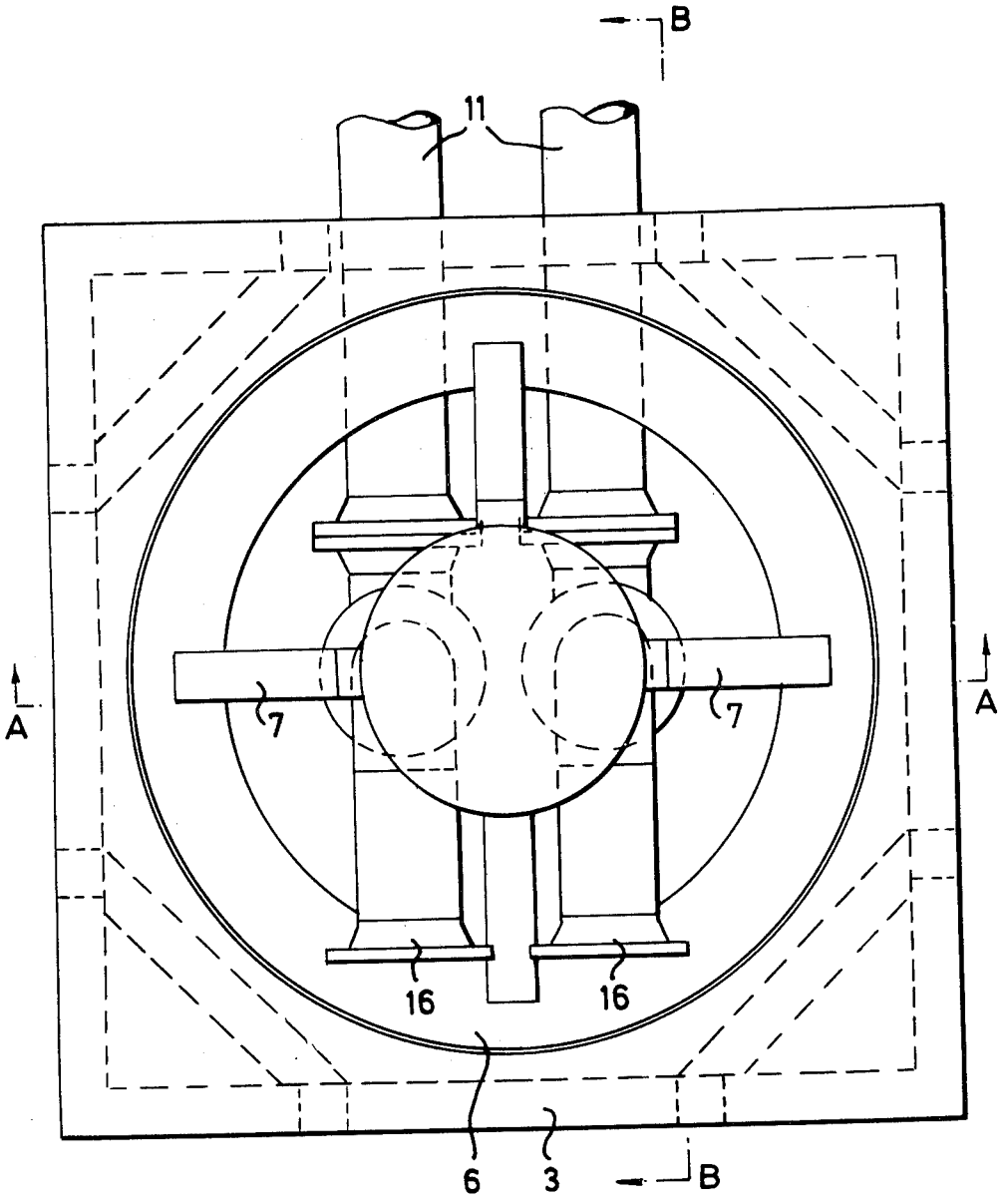
FIG. 2 is a more detailed plan view of a support and swivel.
Figure 3:
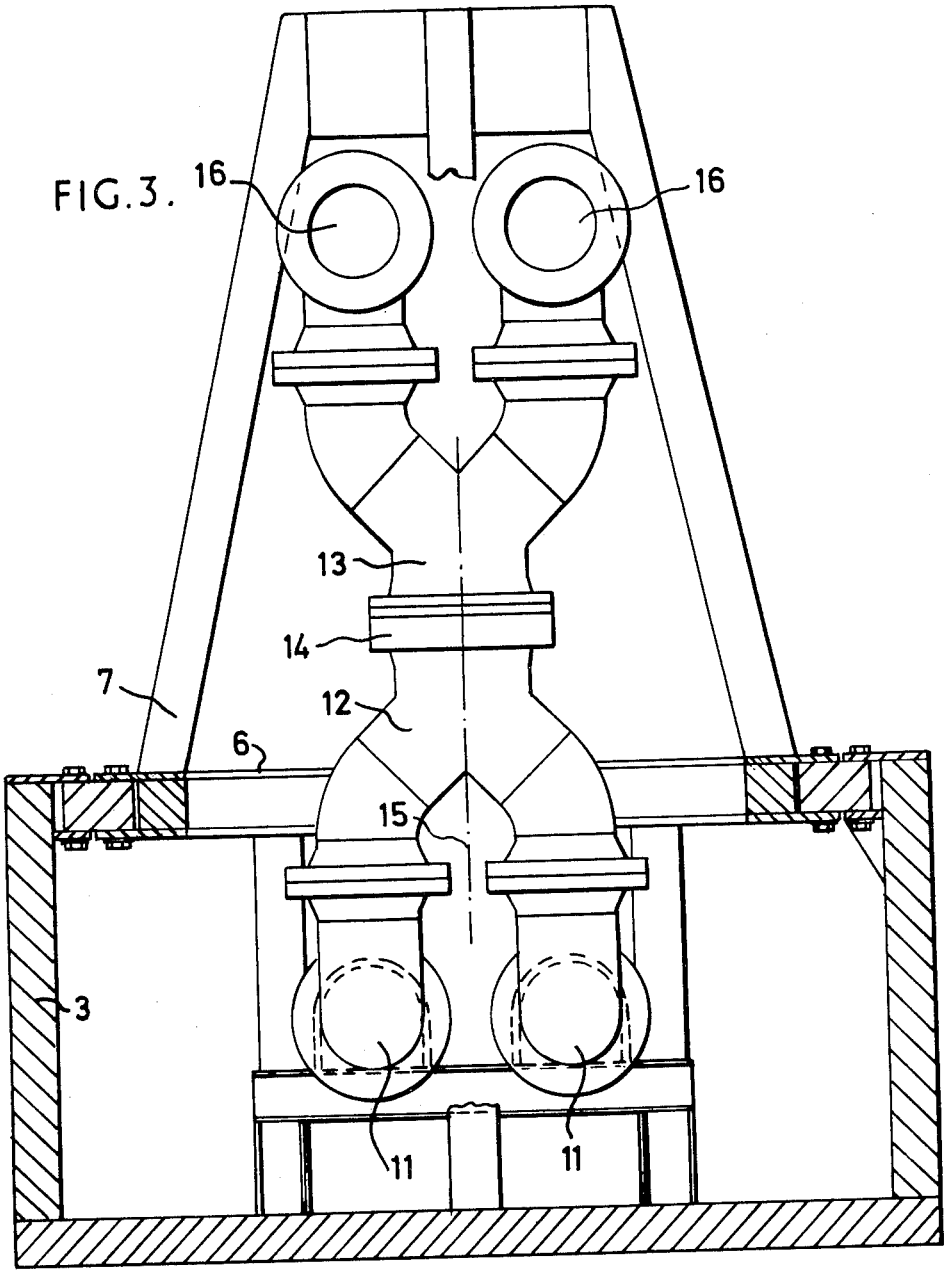
FIGS. 3 and 4 are sectional elevations along the lines A—A and B—B respectively of FIG. 2.
Figure 4:
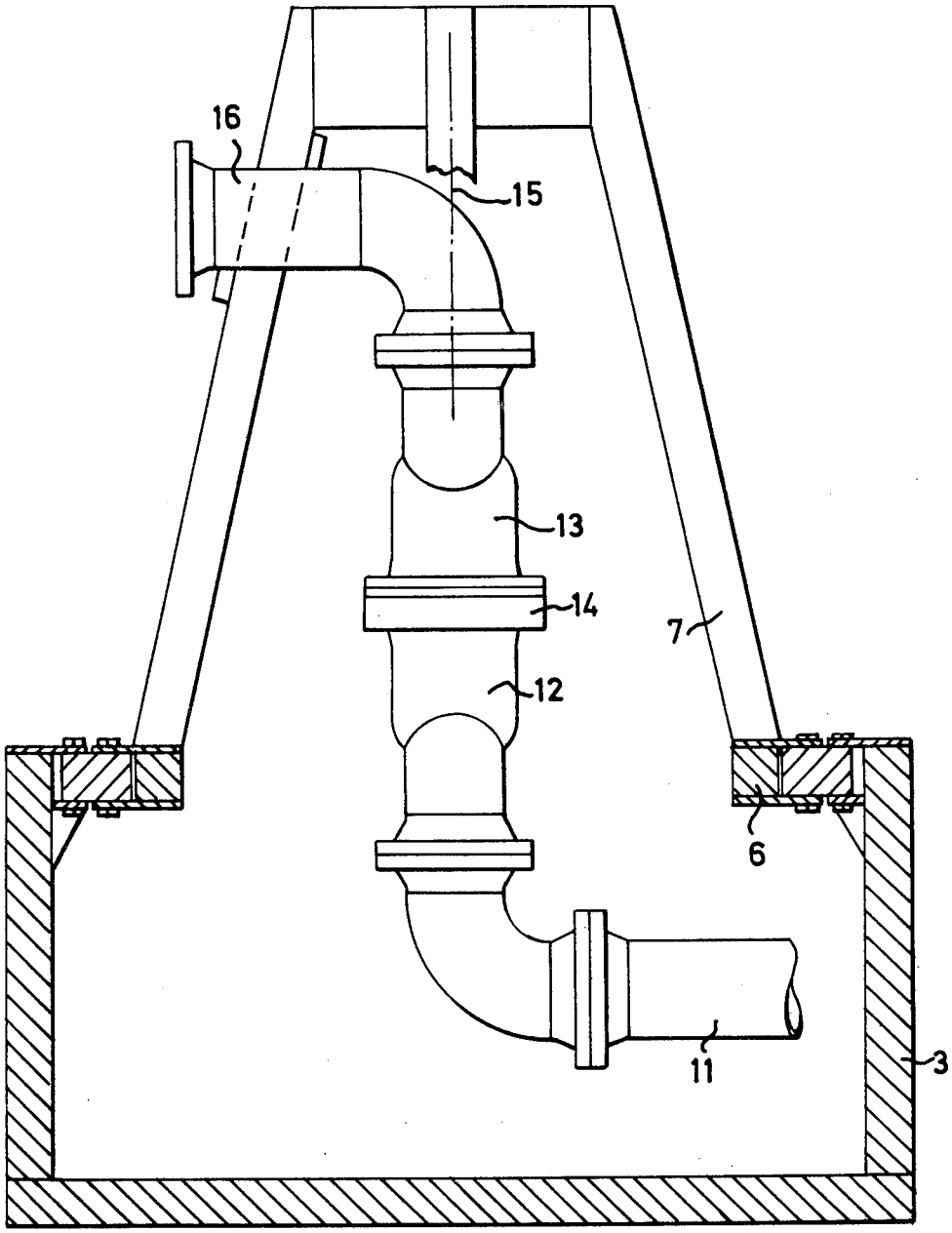

The two lines 1 are joined to a swivel unit 10 and referring to FIGS. 1, 2, 3 and 4 it will be seen that two horizontal pipes 11 connected to the lines 1 are connected to a Y-shaped pipe unit 12 which is coupled to another Y-shaped pipe unit 13 through a swivel 14 which permits relative rotation of the two Y-shaped pipe units 12 and 13 about a vertical axis 15 which is also the axis of the turntable 6. The Y-shaped pipe unit 13 has its outlets 16 connected to a pair of flexible hose lines 17. The pipes 11 and lines 17 do of course, extend away from the swivel unit 10 in opposite directions.

The buoy 8 is a mooring tower of cylindrical steel fabrication which is ring tiffened and stiffened into several compartments individually sealed.

The upper end of the buoy carries fenders 18 and a mooring line assembly 19 as well as a navigational marker at the end of a pole 20.

In use, the flexible hose lines are of course connected at their outer ends to a moored ship and have their initial sections stiffened and unbuoyed so that they remain below the sea surface whereas the final sections of the flexible hose lines are of the self buoyant type. The sections of buoyant hose have marker lights attached to them.

The mooring line is designed for use with a bow grapple system.

The product may be iron ore or any other mineral.

The product lines are independent of the mooring arrangements and could be used without the buoy 8, the coupling 9, and the mooring line 19. Obviously the size of the mooring buoy 8 could be changed.

The compartments of the buoy 8 may be individually replaceable.

We claim:

1. An offshore product-loading terminal comprising in combination:

a support on a sea bed;

a turntable having a lower part fixed to said support and an upper part rotatable relative to said lower part about a vertical axis passing through said turntable;

a buoy including means for mooring a ship;

a universal joint connecting said buoy to said upper part of said turntable, said buoy being rotationally coupled by said joint to said upper part for joint rotation therewith, and said buoy, joint, and turntable constituting a force-transmission path from said means for mooring to said support;

a pipe swivel outside said force path and including a first portion carried by said support and a second portion rotatable about said vertical axis relative to said first portion;

an input line connected to one of said portions and connectable to a source of the product to be loaded;

an output line connected to the other of said portions and connectable to a deposit location for the product to be loaded, the line connected to said second portion being flexible.

2. An offshore product-loading terminal as defined in claim 1, wherein said upper part of said turntable is an upwardly frustoconical frame enclosing a frustoconical space, said buoy being above said turntable.

3. An offshore product-loading terminal as defined in claim 2, wherein said pipe swivel comprises a substantially upright portion intermediate said first and second portions and extending from a location below said frustoconical frame to a location within the frustoconical space.

4. An offshore product-loading terminal as defined in claim 3, wherein said substantially upright portion of said pipe swivel comprises a first wye having downwardly directed arms; a second wye having upwardly directed arms; and a swivel connecting said first and second wyes; the arms of said first wye being connected to said first portion of said pipe swivel and the arms of said second wye being connected to said second portion of said pipe swivel, said input line being connected to said first portion of said pipe swivel, and said output line being connected to said second portion of said pipe swivel, said second wye being rotatable about said vertical axis relative to said first wye.

5. An offshore product-loading terminal as defined in claim 4, wherein said input line also is flexible and said first wye and second first portion are rotatable about said vertical axis relative respectively to said second wye and to second portion of said pipe swivel.

6. An offshore product-loading terminal as defined in claim 1, said pipe swivel being free of mechanical connection to said turntable, said buoy and said universal joint being out of direct connection with said input and output lines, said input line being fixed to said support.

7. An offshore product-loading terminal as defined in claim 4, wherein said first and second portions of said pipe swivel each comprise two discrete pipes each connected to a respective arm of said first and second wyes respectively, and said input and output lines each comprise two discrete conduits each connected to a respective discrete pipe of said first and second portions respectively.

8. An offshore product-loading terminal as defined in claim 1, said turntable being carried by said support; said lower part of said turntable being a frame; said input line being connected to said first portion of said pipe swivel; said first portion being connected to and carried by said support and extending inside the frame of said lower part; said pipe swivel including a substantially upright portion connected to said first portion and extending upwardly from said lower part into said upper part of said turntable; said upper part of said turntable being an upwardly frustoconical frame; said second portion connected to and extending from said substantially upright portion to a point outside said upper part and at this point being connected to said output line, said joint containing and carrying none of the product; said buoy being carried above said joint and said turntable being connected at its bottom to said joint and being uncontacted by said input and output lines; wherein said turntable, said joint and said pipe swivel are all immersable in water and are below said buoy.

9. An offshore product loading terminal as claimed in claim 1 wherein the support is held on the sea bed by gravity.

10. An offshore product loading terminal as claimed in claim 1 wherein the buoy is divided into a plurality of compartments individually sealed.

11. An offshore product loading terminal as claimed in claim 1 wherein the buoy is cylindrical, is of steel, and is ring stiffened.

* * * * *